US010577891B2

(12) United States Patent
Zhai et al.

(10) Patent No.: US 10,577,891 B2
(45) Date of Patent: Mar. 3, 2020

(54) USING HORIZONTAL DIRECTIONAL DRILLING AND LIQUID NITROGEN CYCLIC FREEZE-THAW PROCESS TO IMPROVE PERMEABILITY IN GAS DRAINAGE

(71) Applicant: Science Academy of China University of Mining, Xuzhou (CN)

(72) Inventors: Cheng Zhai, Xuzhou (CN); Lei Qin, Xuzhou (CN); Jizhao Xu, Xuzhou (CN); Zongqing Tang, Xuzhou (CN); Shiliang Wu, Xuzhou (CN); Chao Zhong, Xuzhou (CN)

(73) Assignee: SCIENCE ACADEMY OF CHINA UNIVERSITY OF MINING AND TECHNOLOGY, Suzhou (CN)

( * ) Notice: Subject to any disclaimer, the term of this patent is extended or adjusted under 35 U.S.C. 154(b) by 524 days.

(21) Appl. No.: 15/307,006

(22) PCT Filed: Dec. 29, 2015

(86) PCT No.: PCT/CN2015/099318

§ 371 (c)(1),
(2) Date: Oct. 27, 2016

(87) PCT Pub. No.: WO2017/020516

PCT Pub. Date: Feb. 9, 2017

(65) Prior Publication Data

US 2017/0175489 A1 Jun. 22, 2017

(30) Foreign Application Priority Data

Aug. 3, 2015 (CN) ..... 2015 1 0480831

(51) Int. Cl.
*E21B 36/00* (2006.01)
*E21F 7/00* (2006.01)
(Continued)

(52) U.S. Cl.
CPC ..... *E21B 36/001* (2013.01); *E21B 17/02* (2013.01); *E21B 43/243* (2013.01); *E21F 7/00* (2013.01)

(58) Field of Classification Search
CPC ..... E21F 7/00; E21B 43/168; E21B 43/243; E21B 36/001; E21B 7/046; E21B 41/0035
See application file for complete search history.

(56) References Cited

U.S. PATENT DOCUMENTS 1,867,758 A * 7/1932 Ranney ..... E21B 43/295 299/2
4,271,676 A * 6/1981 Hvizdos ..... E21F 7/00 166/267

(Continued)

FOREIGN PATENT DOCUMENTS

CA 2840118 A1 * 12/2012 ..... E21B 43/26
CN 103397900 11/2013

(Continued)

*Primary Examiner* — Jennifer H Gay
(74) *Attorney, Agent, or Firm* — Treasure IP Group, LLC

(57) ABSTRACT

A liquid nitrogen cyclic freeze-thaw permeability-improvement gas drainage method based on horizontal directional boreholes comprises: first constructing a main borehole at an intake roadway or a return roadway, a low-level roadway and a high-level roadway, after a drill bit reaches a pre-set target position of a coal bed, uniformly and directionally constructing a plurality of branch boreholes along a horizontal direction of the coal bed, injecting water to the coal bed, opening a valve, filling the main boreholes with liquid nitrogen, rapidly freezing the water injected into the branch boreholes and the periphery of the coal bed, and stopping injecting the nitrogen when an average temperature of a pre-permeability-improvement area monitored by a temperature measuring hole is lowered to −2° C. or lower.

3 Claims, 7 Drawing Sheets

(51) Int. Cl.
*E21B 17/02* (2006.01)
*E21B 43/243* (2006.01)

(56) References Cited

U.S. PATENT DOCUMENTS

| | | | | |
|---|---|---|---|---|
| 4,320,627 | A * | 3/1982 | Hvizdos | E21F 7/00 299/12 |
| 5,388,642 | A | 2/1995 | Puri et al. | |
| 7,264,049 | B2 * | 9/2007 | Maguire | E21B 43/247 166/245 |
| 7,775,281 | B2 * | 8/2010 | Kosakewich | E21B 43/26 166/302 |
| 8,448,708 | B2 * | 5/2013 | Kosakewich | E21B 36/001 166/302 |
| 9,243,485 | B2 * | 1/2016 | Kosakewich | E21B 43/2405 |
| 2006/0213658 | A1 * | 9/2006 | Maguire | E21B 43/247 166/245 |
| 2008/0035345 | A1 * | 2/2008 | Kosakewich | E21B 36/001 166/302 |
| 2009/0101348 | A1 * | 4/2009 | Kaminsky | E21B 36/001 166/302 |
| 2010/0263874 | A1 * | 10/2010 | Kosakewich | E21B 36/001 166/308.1 |
| 2014/0216728 | A1 * | 8/2014 | Kosakewich | E21B 43/26 166/249 |
| 2017/0175489 | A1 * | 6/2017 | Zhai | E21F 7/00 |

FOREIGN PATENT DOCUMENTS

| | | |
|---|---|---|
| CN | 104614497 | 5/2015 |
| CN | 104632271 | 5/2015 |
| CN | 104712302 | 6/2015 |
| CN | 105134284 | 12/2015 |

* cited by examiner

C–C / D–D

USING HORIZONTAL DIRECTIONAL DRILLING AND LIQUID NITROGEN CYCLIC FREEZE-THAW PROCESS TO IMPROVE PERMEABILITY IN GAS DRAINAGE

CROSS REFERENCE TO RELATED APPLICATION

This application is a National Phase application of, and claims priority to, PCT Application No. PCT/CN2015/099318, filed on Dec. 29, 2015 entitled "Using horizontal directional drilling and liquid nitrogen cyclic freeze-thaw process to improve permeability in gas drainage," which claims priority to Chinese Application No. 201510480831.8, filed on Aug. 3, 2015. Both the PCT Application and Chinese Application are incorporated herein by reference in their entireties.

BACKGROUND

Technical Field

The present invention relates to a gas drainage method, and in particular to a gas drainage liquid nitrogen cyclic freeze-thaw permeability-improvement and pressure relief method.

Related Art

Gas disaster is a main reason causing the catastrophic disaster of coal mines in China. Along with the high-efficiency intensification and the increased mining depth of the coal mines, the emission rate of gas is higher and higher, and the gas explosion and the gas burst have become a difficulty to be solved of mines. At present, gas drainage is one of most effective ways for solving the gas disaster. The coal bed in China is generally the high-gas low-permeability coal bed, so the gas is difficult to drain. Solving the problems of low gas drainage concentration and small emission amount is always the most important thing for controlling the gas disaster. At present, the permeability of the coal bed is increased by generally adopting the methods such as hydraulic fracturing, hydraulic slotting and presplitting blasting; however, as the mining depth is increased, the permeability of the coal mass is poor and poor; and a conventional coal bed permeability improvement gas drainage method is small in fracturing permeability improvement range, and a large-area gas drainage crack net cannot be formed in the coal mass, so the gas drainage rate is low, and the gas control effect is not ideal.

SUMMARY OF THE INVENTION

The technical problem: the present invention aims at providing a liquid nitrogen cyclic freeze-thaw permeability-improvement gas drainage method based on horizontal directional boreholes. By means of the cyclic freeze-thaw permeability improvement of the liquid nitrogen, cracks of the low-permeability coal bed are developed and expanded to form a gas drainage crack net, thereby effectively improving the gas drainage of the low-permeability coal bed.

The technical solution: the liquid nitrogen cyclic freeze-thaw permeability-improvement gas drainage method based on the horizontal directional boreholes comprises the following steps:

a. constructing a main borehole to a permeability-improvement drainage coal bed in an intake roadway or a return roadway of a recovery coal bed along a bedding of the coal bed, a penetrating layer of a low-level roadway or a penetrating layer of a high-level roadway, according to the thickness of the coal bed, when the main borehole reaches a position 2 m to 10 m distanced to the upper edge of the coal bed, taking the main borehole as a center, and uniformly and directionally constructing a plurality of branch boreholes with a same angle and with a length of 30 m to 50 m along the horizontal direction of the coal bed by adopting a horizontal directional drilling machine;

b. arranging a low-temperature-resistant steel pipe in the main borehole after the drilling machine is withdrawn, wherein the front portion of the low-temperature-resistant steel pipe is a floral pipe with a length of 1 m to 3 m, and sealing the front portion of the floral pipe; forming a pressure measuring port on the low-temperature-resistant steel pipe, and connecting a high-pressure pressure gauge at the pressure measuring port;

c. injecting well-prepared high-pressure borehole sealing material slurry into a crack between the low-temperature-resistant steel pipe and the main borehole by virtue of a grouting pump to perform the grouting hole sealing, wherein the length H of a grouting hole sealing section is 15 m to 25 m;

d. symmetrically constructing two temperature measuring holes at two sides of the low-temperature-resistant steel pipe, wherein a distance L from the center of the two temperature measuring holes to the center of the main borehole is 30 m to 50 m, and an area between the two temperature measuring holes is a coal bed fracturing permeability improvement area; arranging a temperature sensor in each temperature measuring hole, connecting each temperature sensor to a digital display temperature instrument arranged outside a porthole by leading out a conducting wire, arranging a sensor casing pipe fixed by a temperature measuring hole sealing section at an inlet section of each temperature measuring hole, and monitoring the temperature in a borehole temperature measuring area in real time by pushing and pulling the temperature sensor forwards and backwards in the sensor casing pipe, wherein the arrangement length of the borehole temperature measuring area in the coal bed is 5 m to 10 m;

e. injecting water into the low-temperature-resistant steel pipe via a rapid connector by utilizing a water injection device provided in the intake roadway or the return roadway, the injected water being divided by the low-temperature-resistant steel pipe, entering from six branch boreholes, permeating to remain in the coal mass, and continuously permeating and entering micro coal-bed cracks;

f. after the injected water permeably flows for 2 to 3 hours in the coal mass, removing a water injection valve on the rapid connector, installing a liquid nitrogen valve, connecting the low-temperature-resistant steel pipe in the main borehole to a liquid nitrogen tank car provided in the intake roadway or the return roadway, opening the liquid nitrogen valve, filling the low-temperature-resistant steel pipe in the main borehole with liquid nitrogen, monitoring the temperature in the borehole temperature measuring area through the temperature measuring holes, when an average temperature at two ends in the borehole temperature measuring area is lower than −2° C., determining that the coal bed fracturing permeability improvement area is already at a frozen state, closing the liquid nitrogen valve to stop injecting the nitrogen, making the coal mass naturally thawed for 2 to 3 hours, and completing a freeze-thaw cycle of a phase changer fracturing unit;

g. according to a conventional method, implementing the gas drainage borehole to the coal bed in the coal bed fracturing permeability improvement area between the two temperature measuring holes, and draining the gas; and h. in the gas drainage process, according to the variation of the gas drainage effect, injecting water and liquid nitrogen repeatedly for multiple times to the coal bed through the low-temperature-resistant steel pipe and the six branch boreholes, wherein the coal mass reaches a coal mass stress fatigue limit under the alternative effect of freezing-thawing-freezing in multiple freeze-thaw cycles and is fractured.

In the liquid nitrogen filling process, when the pressure of the liquid nitrogen in the low-temperature-resistant steel pipe is higher than 8 MPa, the liquid nitrogen valve is closed, and when the pressure is lower than 2 MPa, the liquid nitrogen valve is opened to continuously fill the liquid nitrogen.

The number of branch boreholes (1) with the same angle and with the length of 30 m to 50 m uniformly distributed and directionally constructed along the horizontal direction of the coal bed is 4 to 8.

The present invention has the beneficial effects: the present invention drains the gas on the basis of the liquid nitrogen freeze-thaw permeability improvement of the horizontal directional boreholes, wherein: (1) a horizontal directional drilling technology is a novel construction technology combining a directional drilling technology in the petroleum industry and the traditional pipeline construction method and has been developed rapidly in more than ten years; and the horizontal directional drilling technology has the advantages of high construction speed, high construction precision, low cost and applicability to the hard rock operation and is widely applied to the construction work, and its directional drilling has an extraordinary advantage in implementing the directional drilling of the coal mine. The freeze-thaw phenomenon is a conventional physical geographic action and phenomenon in the nature, and especially occurs in the object construction relatively large in variation of a temperature difference, such as roads and buildings in Qinghai-Tibet Plateau and northern districts. The severe freeze-thaw disaster of Qinghai-Tibet roads brings about a great difficulty to the safe transportation, road maintenance and construction. (2) The freeze-thaw erosion is a phenomenon that when water in soil and soil matrix pores or rock cracks is frozen, the volume of the water is expanded, resulting in enlargement and increment of cracks, thus leading to the fracturing of the whole soil mass or rock, and after the water is thawed, the erosion-resistant stability is greatly reduced, and the rock and the soil move downwards along a slope under the action of the gravity. The freeze-thaw erosion causes the repeated thawing and freezing of frozen earth, thereby leading to the damage, disturbance, deformation and even motion of the soil mass or rock mass. The phenomenon that the freezing and the thawing of water contained on the surface and inside a structural member are alternated is called a freeze-thaw cycle. The repeated occurrence of the freeze-thaw cycle causes the severe damage to the object construction. The freeze-thaw erosion and cycling process has a wide application prospect in the coal mass fracturing permeability improvement. (3) Under the normal pressure, the temperature of the liquid nitrogen can reach −196° C., the vaporization latent heat is 5.56 kJ/mol, 1 $m^3$ liquid nitrogen can be expanded to 696 $m^3$ pure gaseous nitrogen with the temperature of 21° C., and a great amount of ambient heat can be absorbed during vaporization. The liquid nitrogen has the advantages of simple operation, wide source of raw materials and the like. In the freeze-thaw cycle of the coal mass, the liquid nitrogen can be used as a high-efficiency refrigerating and permeability-improvement medium.

The present invention innovatively employs the freeze-thaw erosion phenomenon and the freeze-thaw cycle to the fracturing permeability-improvement gas drainage of the coal mass and employs the branch boreholes to guide the medium water to be seeped into the coal mass; the deep-cold liquid nitrogen is used as a refrigerating medium and is expanded to 696 times of nitrogen gas during gasification, on one hand, the expansion action effectively accelerates the motion of the water in the macro cracks of the coal mass and increases the content of the water in the micro-pores, therefore, the freeze-thaw cycle has a larger permeability improvement area; and on the other hand, the collective action of the liquid nitrogen gasification expansive force and the water phase change frost heaving force and flowing osmotic pressure forces the macro cracks and the micro cracks in the coal mass to be expanded, developed and communicated, thereby increasing the freeze-thaw efficiency. The present invention has the advantages as follows:

In the cyclic freeze-thaw process, the liquid medium in the coal mass has a freezing-expansion-thawing-freezing cyclic process, the coal bed reaches a fatigue and stress limit under the alternative stress, and the collective action of the phase change freeze expansive force of the water, the vaporization expansive force of the liquid nitrogen and the liquid flowing osmotic pressure in the thawing process forces the macro-cracks to be developed and communicated and the micro-pores to be expanded to form a gas drainage crack net, thereby effectively releasing the pressure of the coal bed, and improving the permeability of the coal bed. Six branch boreholes are formed at 360 degrees along the coal bed; the branch boreholes guide the medium water and the refrigerating medium to be sufficiently seeped into the coal mass; the freeze-thaw permeability improvement range can reach 30 m to 60 m; and after the freeze-thaw range is enlarged, the number of the freeze-thaw units and the quantity of the gas drainage boreholes can be obviously reduced.

The low-temperature-resistant steel pipe is connected with the freeze-thaw unit through the rapid connector, and the floral pipe on the front portion of the steel pipe can transport the medium water and the liquid nitrogen in all directions, thereby realizing multiple functions, and saving the work amount.

By means of the cyclic freeze-thaw, the gas single-hole drainage amount and the drainage concentration of the coal bed can be effectively increased, and the attenuation time of the gas concentration is prolonged.

Since the medium water is uniformly dispersed into the coal bed through the branch boreholes, a local high-stress concentration area of the coal bed can be effectively eliminated after the water is thawed, the transportation of the local accumulated gas is promoted, and the accumulated coal and gas burst potential in the coal bed is released, thereby having an effect of well eliminating the coal and gas burst.

In addition, when the refrigerating medium liquid nitrogen is vaporized, a great amount of ambient heat can be absorbed, thereby having an effect of cooling the coal mass, and achieving a positive significance on preventing the fire of the coal bed. The method of the present invention effectively solves the problems of low gas drainage efficiency, long drainage period, and small drainage borehole influence range of the high-gas low-permeability coal bed, thereby having wide practicability.

Figure 1:
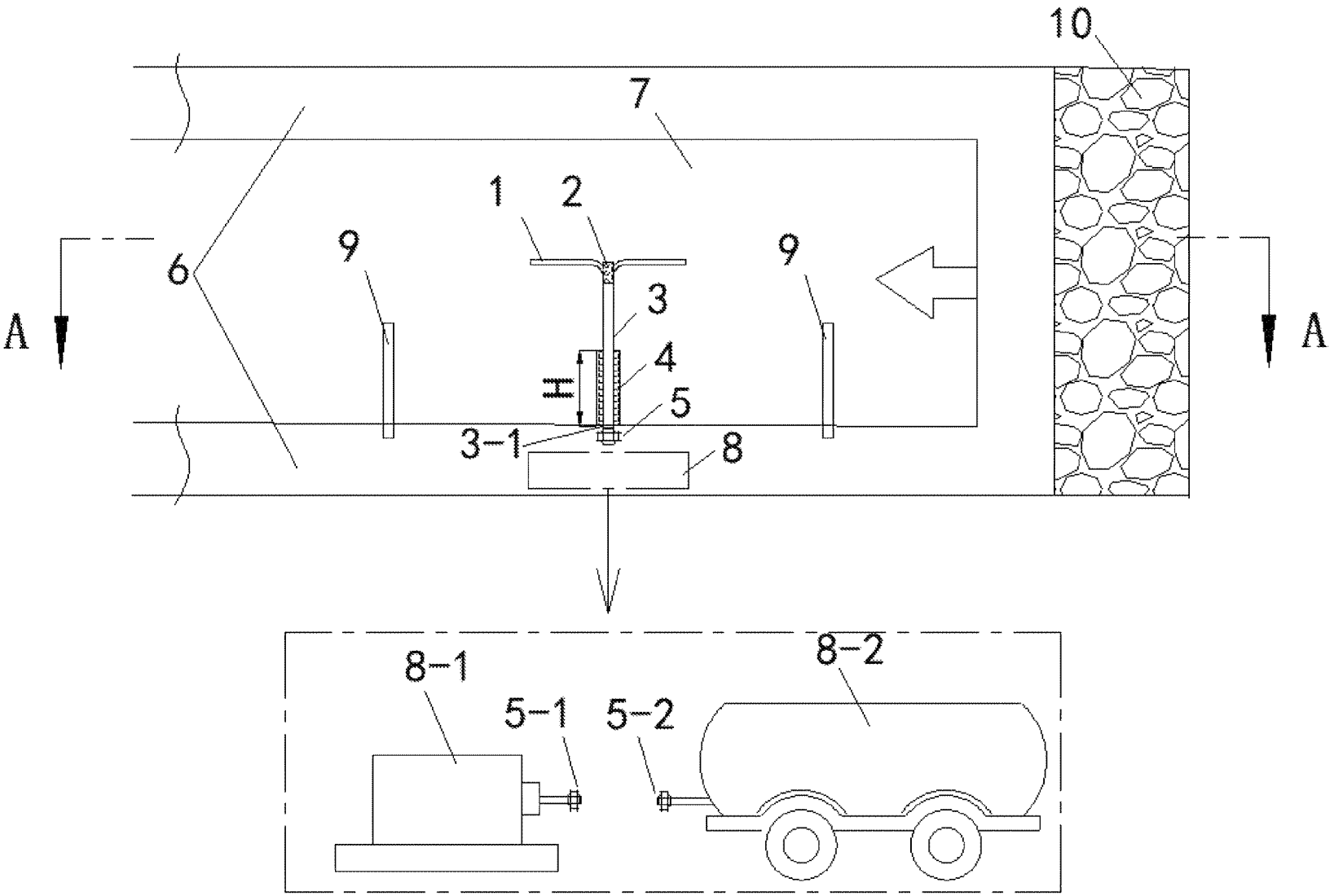
FIG. 1 is a schematic diagram of the coal-bed bedding directional borehole liquid nitrogen cyclic freeze-thaw permeability improvement gas drainage method.
Figure 2:
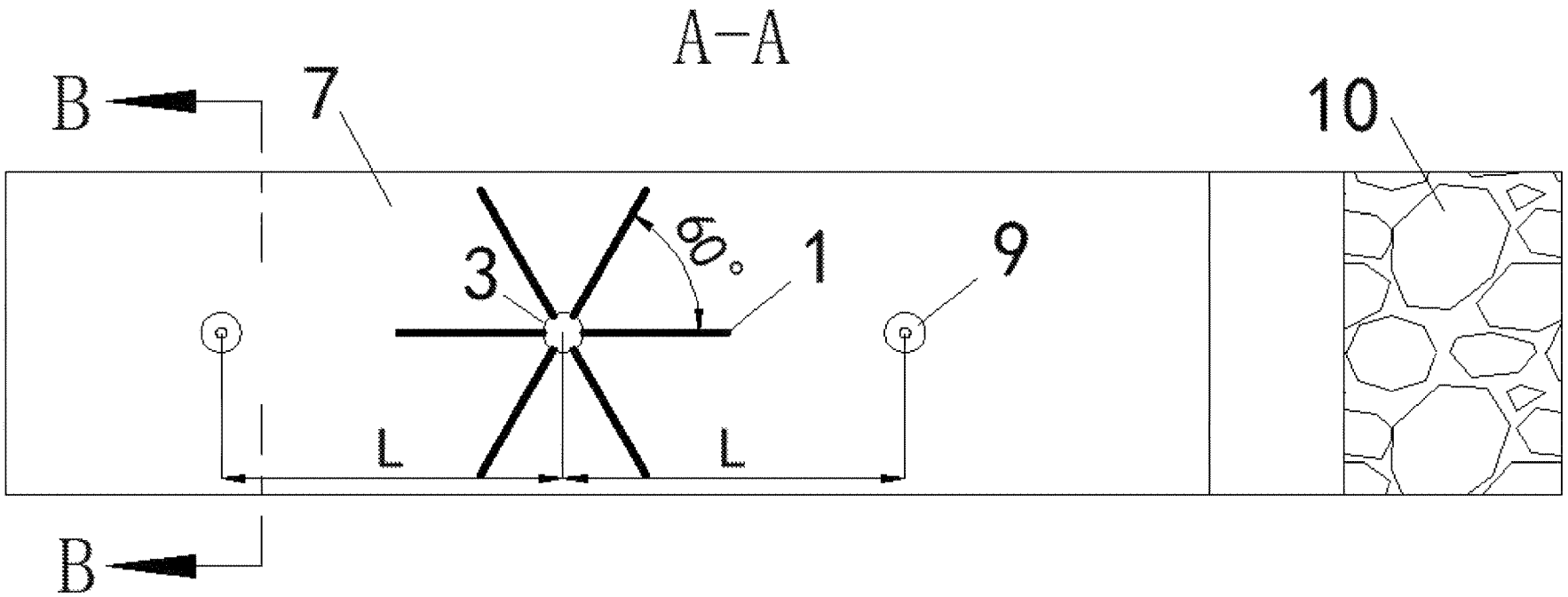
FIG. 2 is a schematic diagram of an A-A section of FIG. 1.
Figure 3:
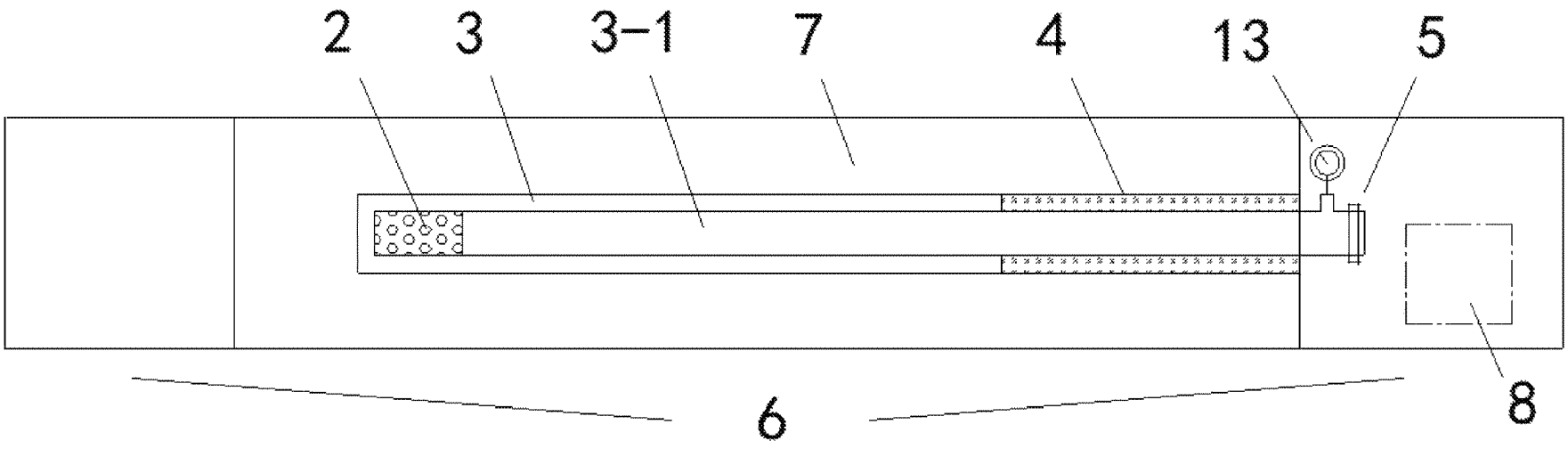
FIG. 3 is a schematic diagram of layout and connection of the steel pipe in the main borehole in FIG. 1, FIG. 5 and FIG. 6.
Figure 4:
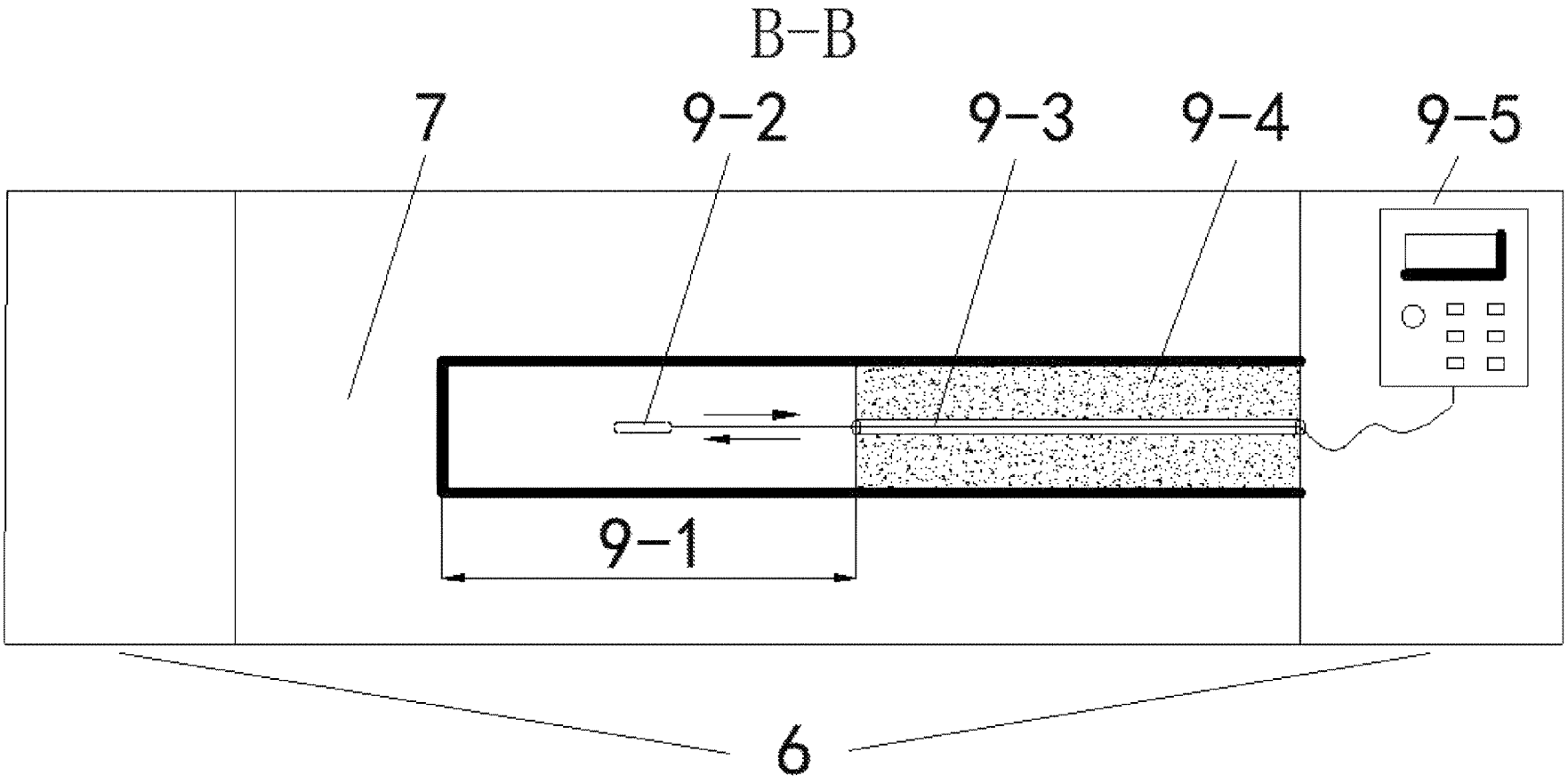
FIG. 4 is a schematic diagram of the temperature measuring hole of a B-B section in FIG. 2 and FIG. 7.

Wherein: 1—branch borehole, 2—floral pipe, 3—main borehole, 3-1—low-temperature-resistant steel pipe, 4—hole sealing section, 5—rapid connector, 5-1—water injection valve, 5-2—liquid nitrogen valve, 6—intake roadway or return roadway, 7—coal bed, 8—device unit, 8-1—water injection device, 8-2—liquid nitrogen tank car, 9—temperature measuring hole, 9-1—borehole temperature measuring area, 9-2—temperature sensor, 9-3—sensor moving casing pipe, 9-4—temperature measuring hole sealing section, 9-5—digital display temperature instrument, 10—gob, 11—low-level roadway, 12—high-level roadway, 12—high-pressure pressure gauge.

DETAILED DESCRIPTION

Embodiments of the present invention are further described in detail in combination with the attached drawings:

A liquid nitrogen cyclic freeze-thaw permeability-improvement gas drainage method based on the horizontal directional borehole comprises the steps as follows:

a. constructing a main borehole 3 to a permeability-improvement drainage coal bed 7 in an intake roadway or a return roadway 6 of a recovery coal bed along a bedding of the coal bed, a penetrating layer of a low-level roadway or a penetrating layer of a high-level roadway, according to the thickness of the coal bed 7, when the main borehole 3 reaches a position 2 m to 10 m distanced to the upper edge of the coal bed 7, taking the main borehole 3 as a center, and uniformly and directionally constructing a plurality of branch boreholes 1 with the same angle and with a length of 30 m to 50 m along the horizontal direction of the coal bed 7 by adopting a horizontal directional drilling machine;

b. arranging a low-temperature-resistant steel pipe 3-1 in the main borehole 3 after the drilling machine is withdrawn, wherein the front portion of the low-temperature-resistant steel pipe 3-1 is a floral pipe 2 with a length of 1 m to 3 m, and sealing the front portion of the floral pipe 2; forming a pressure measuring port on the low-temperature-resistant steel pipe 3-1, and connecting a high-pressure pressure gauge 13 at the pressure measuring port;

c. injecting well-prepared high-pressure borehole sealing material slurry into a gap between the low-temperature-resistant steel pipe 3-1 and the main borehole 3 by virtue of a grouting pump to perform the grouting hole sealing, wherein the length H of a grouting hole sealing section 4 is 15 m to 25 m;

d. symmetrically constructing two temperature measuring holes 9 at two sides of the low-temperature-resistant steel pipe 3-1, wherein a distance L from the centers of the two temperature measuring holes 9 to the center of the main borehole 3 is 30 m to 50 m, and an area between the two temperature measuring holes 9 is a coal bed fracturing permeability improvement area; arranging a temperature sensor 9-2 in each temperature measuring hole 9, connecting each temperature sensor 9-2 to a digital display temperature instrument 9-5 arranged outside a porthole by leading out a conducting wire, arranging a sensor casing pipe 9-3 fixed by a temperature measuring hole sealing section 9-4 at an inlet section of each temperature measuring hole 9, and monitoring the temperature in a borehole temperature measuring area 9-1 in real time by pushing and pulling the temperature sensor 9-2 forwards and backwards in the sensor casing pipe 9-3, wherein the arrangement length of the borehole temperature measuring area 9-1 in the coal bed 7 is 5 m to 10 m;

e. injecting water into the low-temperature-resistant steel pipe 3-1 via a rapid connector 5 by utilizing a water injection device 8-1 provided in the intake roadway or the return roadway 6, the injected water being divided by the low-temperature-resistant steel pipe 3-1, entering from six branch boreholes 1, permeating to remain in the coal mass, and continuously permeating and entering micro coal-bed cracks;

f. after the injected water permeably flows for 2 to 3 hours in the coal mass, removing a water injection valve 5-1 on the rapid connector 5, installing a liquid nitrogen valve 5-2, connecting the low-temperature-resistant steel pipe 3-1 in the main borehole 3 to a liquid nitrogen tank car 8-2 provided in the intake roadway or the return roadway 6, opening the liquid nitrogen valve 5-2, filling the low-temperature-resistant steel pipe 3-1 in the main borehole 3 with liquid nitrogen, wherein the liquid nitrogen is gasified and expanded to generate expansive pressure, a great amount of heat is absorbed in the gasification process of the liquid nitrogen, the water injected into the branch boreholes and the periphery of the coal bed is rapidly frozen, and free water in the cracks of the coal bed is gradually transformed from liquid to solid during the freezing process to have the phase change; monitoring the temperature in the borehole temperature measuring area 9-1 through the temperature measuring holes 9, when an average temperature at two ends in the borehole temperature measuring area 9-1 is lower than −2° C., determining that the coal bed fracturing permeability improvement area is already at a frozen state, closing the liquid nitrogen valve 5-2 to stop injecting the nitrogen, making the coal mass naturally thawed for 2 to 3 hours, and completing a freeze-thaw cycle of a phase changer fracturing unit; and under the collective action of the water phase change frost heaving force, the liquid nitrogen gasification expansive force and the microporous liquid flowing osmotic pressure, the macro cracks and the micro cracks of the coal mass are expanded and communicated to form a crack net, thereby improving the permeability of the coal bed;

g. after the injection of the liquid nitrogen is ended, according to a conventional method, implementing the gas drainage borehole to the coal bed in the coal bed fracturing permeability improvement area between the two temperature measuring holes 9, and draining the gas; and h. in the gas drainage process, according to the variation of the gas drainage effect, injecting water and liquid nitrogen repeatedly for multiple times to the coal bed 7 through the low-temperature-resistant steel pipe 3-1 and the six branch boreholes 1, thereby realizing a purpose of improving the permeability of the coal bed surrounding the borehole and rapidly and effectively draining the gas; and the coal mass reaches a coal mass stress fatigue limit under the alternative effect of freezing-thawing-freezing in multiple freeze-thaw cycles and is fractured.

In the liquid nitrogen filling process, when the pressure of the liquid nitrogen in the low-temperature-resistant steel pipe 3-1 is higher than 8 MPa, the liquid nitrogen valve 5-2 is closed, and when the pressure is lower than 2 MPa, the liquid nitrogen valve 5-2 is opened to continuously fill the liquid nitrogen.

Embodiment I

As shown in FIG. 1, FIG. 2, FIG. 3 and FIG. 4, performing the directional borehole liquid nitrogen freeze-thaw permeability-improvement gas drainage and decompression to the bedding of the coal bed 7 comprises the steps: a main borehole 3 is first constructed to a permeability improvement drainage coal bed area in an intake roadway or return roadway 6 along the bedding of the coal bed, the penetrating layer of the low-level roadway or penetrating layer of the high-level roadway; according to the thickness of the coal bed 7, when the main borehole 3 reaches a position 2 m to 10 m distanced to the upper edge of the coal bed 7, and by taking the main borehole 3 as the center, six branch boreholes 1 with a length of 30 m to 50 m are directly constructed by adopting a guide function of a horizontal directional drilling machine at an interval of 60 degrees along the horizontal direction of the coal bed 7; after the drilling machine is withdrawn, the low-temperature-resistant steel pipe 3-1 is led into the main borehole 3, the front portion of the low-temperature-resistant steel pipe 3-1 is the floral pipe 2 with a length of 1 m to 3 m, the front portion of the floral pipe is sealed, thereby being convenient for transporting the medium water and liquid nitrogen in all directions; the low-temperature-resistant steel pipe 3-1 is provided with a pressure measuring port, and the pressure measuring port is connected with the high-pressure pressure gauge 13; the well-prepared high-pressure borehole sealing material slurry fills a gap between the low-temperature-resistant steel pipe 3-1 and the main borehole 3 through a grouting pump so as to implement the conventional high-pressure hole sealing, and the length H of the grouting hole sealing section 4 is 15 m to 25 m; two temperature measuring holes 9 are symmetrically formed at two sides of the low-temperature-resistant steel pipe 3-1, the distance from the centers of the two temperature measuring holes 9 to the center of the main borehole 30 m to 50 m, and an area between the two temperature measuring holes 9 is a coal-bed fracturing permeability improvement area; a temperature sensor 9-2 is arranged in each temperature measuring hole 9, and each temperature sensor 9-2 is connected with a digital display temperature instrument 9-5 disposed outside porthole by leading out a conducting wire; the inlet section of each temperature measuring hole 9 is provided with the sensor casing pipe 9-3 fixed by the temperature measuring hole sealing section 9-4; the temperature in the borehole temperature measuring area 9-1 is monitored in real time by pushing and pulling the temperature sensor 9-2 in the sensor casing pipe 9-3, and the length of the borehole temperature measuring area 9-1 in the coal bed 7 is 5 m to 10 m; water is injected into the low-temperature-resistant steel pipe 3-1 through the water injection device 8-1, the water injection pressure is controlled at 5 MPa to 10 MPa, after the water injection is ended, the main borehole water injection valve 5-1 is closed, and the injected water permeates the coal mass, remains in the coal mass along the six branch boreholes 1 and continuously flows into the micro cracks; water flows for 2 to 3 hours, the water injection valve 5-1 is removed, the low-temperature-resistant steel pipe 3-1 is connected with the liquid nitrogen tank car 8-2, the liquid nitrogen valve 5-2 is opened to fill the low-temperature-resistant steel pipe 3-1 with liquid nitrogen, the nitrogen injection pressure is controlled at 2 MPa to 8 MPa, when the average temperature of the borehole temperature measuring area 9-1 is monitored to be lower than −2° C. through the temperature sensor 9-2, the nitrogen injection is stopped, the coal mass is naturally thawed for 2 to 3 hours, and a freeze-thaw cycle of the phase change fracturing unit is completed; and in the process of filling the liquid nitrogen, when the pressure of the liquid nitrogen in the low-temperature-resistant steel pipe 3-1 is higher than 8 MPa, the liquid nitrogen valve 5-2 is closed, and when the pressure is lower than 2 MPa, the liquid nitrogen valve 5-2 is opened to continuously fill the liquid nitrogen. The conventional gas drainage borehole is implemented to the coal bed in the coal bed fracturing permeability improvement area so as to drain the gas. In the drainage process, according to the variation of the gas drainage effect, water and liquid nitrogen are repeatedly injected for multiple times into the coal bed, and the coal mass reaches a coal mass stress fatigue limit under the alternative effect of freezing-thawing-freezing in multiple freeze-thaw cycles and is fractured.

Embodiment II

Figure 5:
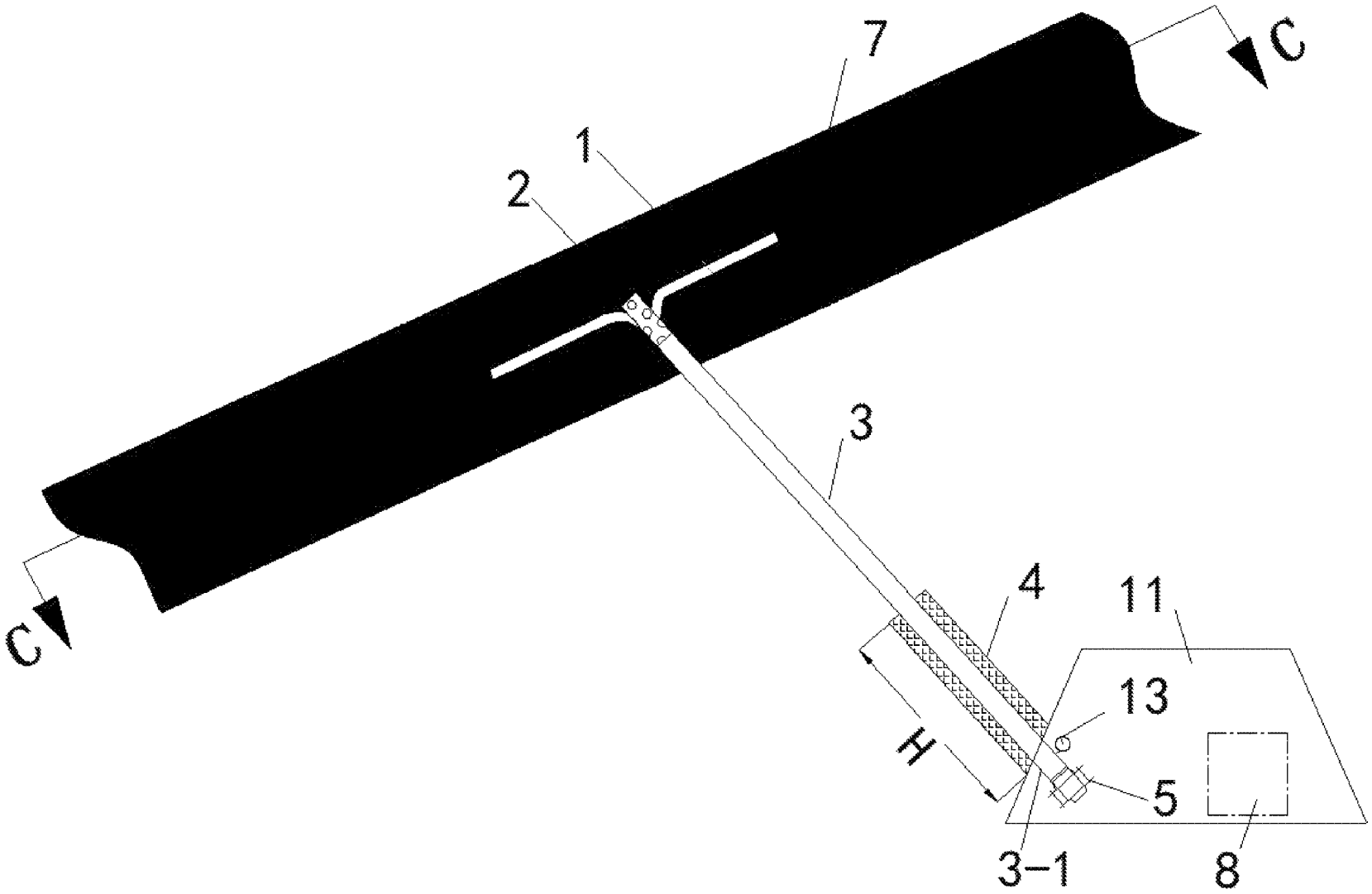
FIG. 5 is a schematic diagram of the low-level roadway penetrating-layer upstream hole liquid nitrogen cyclic freeze-thaw permeability improvement gas drainage method.
Figure 7:
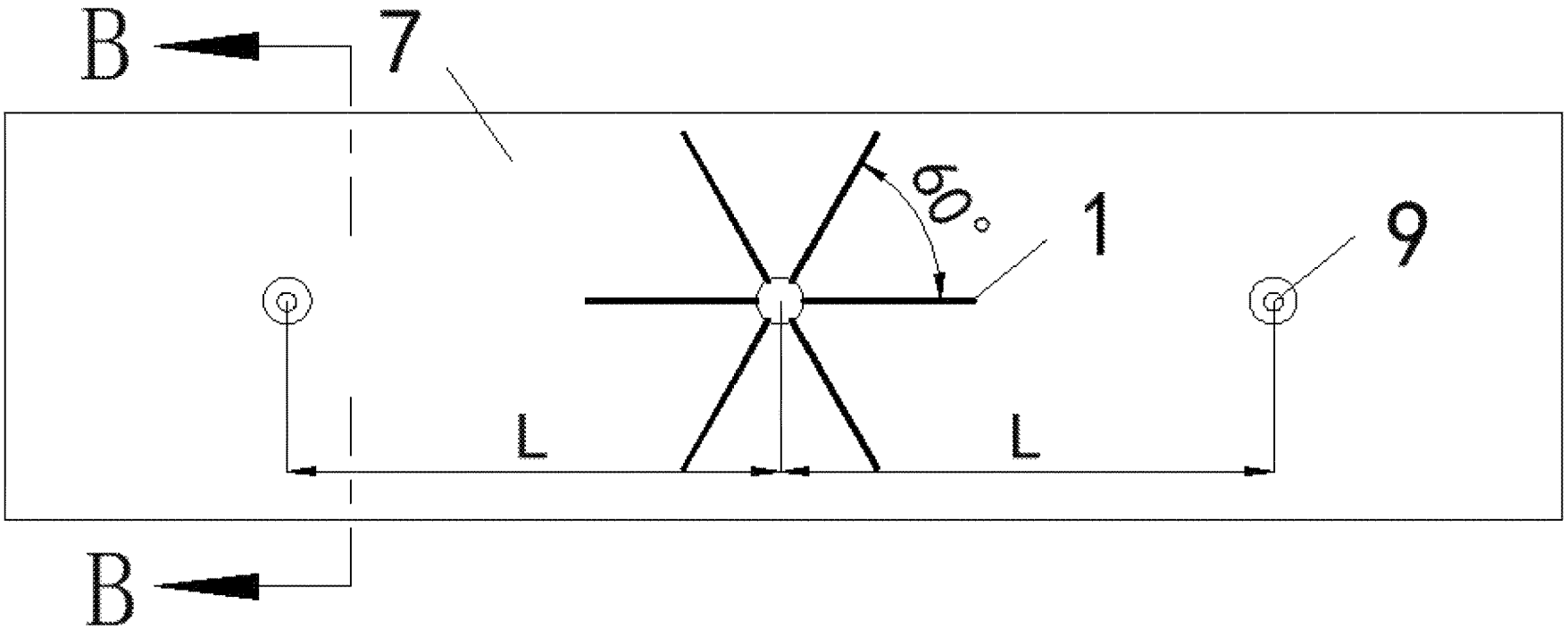
FIG. 7 is a diagram of a C-C section and a D-D section of FIG. 5 and FIG. 6.

As shown in FIG. 5 and FIG. 7, performing the upstream directional borehole liquid nitrogen freeze-thaw permeability-improvement gas drainage and decompression for the penetrating layer of the low-level roadway 11 is basically the same with the embodiment I. The embodiment II differs from the embodiment I in that the freeze-thaw unit is implemented to the freeze-thaw permeability improvement area in the upper coal bed 7 from the penetrating layer of the low-level roadway 11, the depth of the main borehole penetrates through the rock layer to reach the coal bed 7, and according to the thickness of the coal bed, the main borehole shall penetrate into the coal bed for 10 m to 100 m. The remaining part is the same with the embodiment I and is omitted here.

Figure 6:
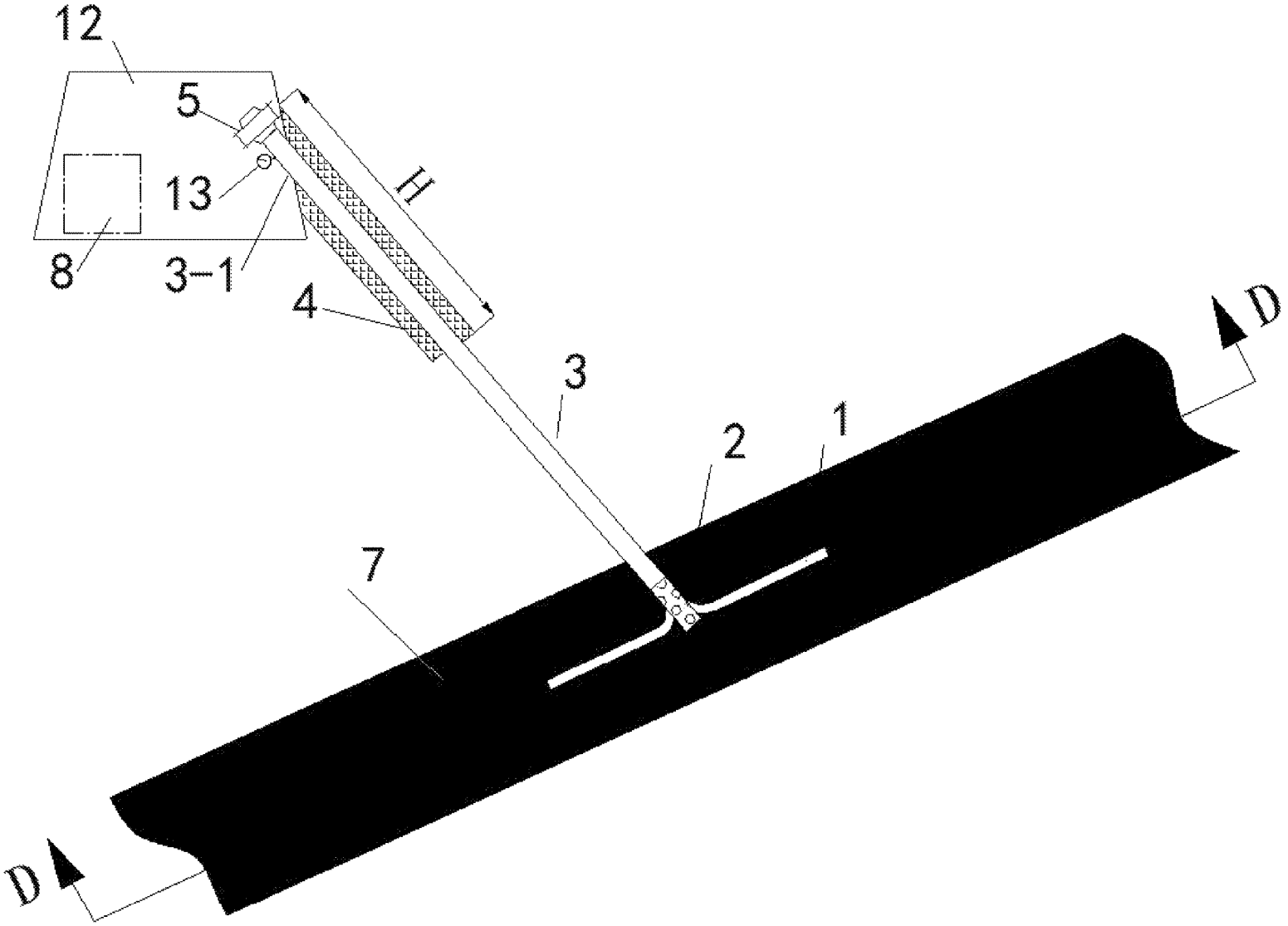
FIG. 6 is a schematic diagram of the high-level roadway penetrating-layer downstream hole liquid nitrogen cyclic freeze-thaw permeability improvement gas drainage method.

As shown in FIG. 6 and FIG. 7, performing the downstream directional borehole liquid nitrogen freeze-thaw permeability-improvement gas drainage and decompression for the penetrating layer of the high-level roadway 12 is basically the same with the embodiment I. The embodiment III differs from the embodiment I in that the freeze-thaw unit is implemented to the freeze-thaw permeability improvement area in the lower coal bed 7 from the penetrating layer of the high-level roadway 12, the depth of the main borehole penetrates through the rock layer to reach the coal bed 7, and according to the thickness of the coal bed, the main borehole shall penetrate into the coal bed for 10 m to 100 m. The remaining part is the same with the embodiment I and is omitted here.

Embodiment III

As shown in FIG. 6 and FIG. 7, performing the downstream directional borehole liquid nitrogen freeze-thaw permeability-improvement gas drainage and decompression for the penetrating layer of the high-level roadway 12 is basically the same with the embodiment I.

The embodiment III differs from the embodiment I in that the freeze-thaw unit is implemented to the freeze-thaw permeability improvement area in the lower coal bed 7 from the penetrating layer of the high-level roadway 12, the depth of the main borehole penetrates through the rock layer to reach the coal bed 7, and according to the thickness of the coal bed, the main borehole shall penetrate into the coal bed for 10 m to 100 m. The remaining part is the same with the embodiment I and is omitted here.

What is claimed is:

1. A gas drainage method to improve permeability, based on horizontal directional boreholes and using liquid nitrogen cyclic freeze-thaw, comprising:

a. constructing a main borehole in a target coal bed in an intake roadway or a return roadway of a recovery coal bed along a bedding of the coal bed, a penetrating layer of a low-level roadway or a penetrating layer of a high-level roadway;

developing a thickness of the main borehole until it reaches a position 2 m to 10 m away from an upper edge of the coal bed, taking the main borehole as a center, and using a horizontal directional drilling machine to uniformly arrange a plurality of branch boreholes along the horizontal direction of the coal bed, wherein the plurality of branch boreholes have same angles and lengths of 30~50 m;

b. arranging a low-temperature-resistant steel pipe in the main borehole after the drilling machine is withdrawn, wherein a front portion of the low-temperature-resistant steel pipe is a floral pipe with a length at 1 m to 3 m, and the front portion of the floral pipe is sealed; wherein a pressure measuring port is provided on the low-temperature-resistant steel pipe, and a high-pressure gauge is connected to the pressure measuring port;

c. injecting a prepared high-pressure borehole sealing material slurry into a gap between the low-temperature-resistant steel pipe and the main borehole by virtue of a grouting pump to perform the grouting hole sealing, wherein length H of a grouting hole sealing section is between 15 m to 25 m;

d. symmetrically constructing two temperature measuring holes surrounding the low-temperature-resistant steel pipe, wherein a distance L from the centers of the two temperature measuring holes to the center of the main borehole is 30 m to 50 m, and an area between the two temperature measuring holes is a coal bed fracturing area;

arranging a temperature sensor in each temperature measuring hole, connecting each temperature sensor to a digital display temperature instrument arranged outside of the temperature measuring holes by leading out a conducting wire, arranging a sensor casing pipe fixed by a temperature measuring hole sealing section at an inlet section of each temperature measuring hole, and monitoring the temperature in a borehole temperature measuring area in real time by pushing and pulling the temperature sensor forwards and backwards in the sensor casing pipe, wherein the arrangement length of the borehole temperature measuring area in the coal bed is 5 m to 10 m;

e. injecting water into the low-temperature-resistant steel pipe via a rapid connector by utilizing a water injection device provided in the intake roadway or the return roadway, the injected water being divided by the floral pipe located at the end portion of the low-temperature-resistant steel pipe, entering from the branch boreholes, permeating to remain in a coal body, and continuously permeating and entering into natural micro coal-bed cracks;

f. removing a water injection valve on the rapid connector after the injected water permeably flows for 2 to 3 hours in the coal mass, installing a liquid nitrogen valve, connecting the low-temperature-resistant steel pipe in the main borehole to a liquid nitrogen tank car provided in the intake roadway or the return roadway (6), opening the liquid nitrogen valve, filling the low-temperature-resistant steel pipe in the main borehole with liquid nitrogen, monitoring the temperature in the borehole temperature measuring area through the temperature measuring holes, measuring a temperature at each end in the borehole temperature measuring area, averaging the temperature measured at each end in the borehole temperature measuring area to obtain an average temperature, determining that the coal bed fracturing permeability improvement area is already at a frozen state, and closing the liquid nitrogen valve to stop injecting the nitrogen when the average temperature is no greater than −2° C., making the coal mass naturally thawed for 2 to 3 hours, and completing a freeze-thaw cycle of a phase changer fracturing unit;

g. implementing a gas drainage borehole to the coal bed in the coal bed fracturing permeability improvement area between the two temperature measuring holes, and draining the gas according to a conventional method; and h. injecting water and filling in liquid nitrogen for multiple cycles to the coal bed through the low-temperature-resistant steel pipe and the branch boreholes, wherein the coal body reaches a coal mass stress fatigue limit under the alternative effect of freezing-thawing-freezing in multiple freeze-thaw cycles and is fractured.

2. The method according to claim 1, characterized in that:

in the liquid nitrogen filling process, turning off the liquid nitrogen valve when the pressure of the liquid nitrogen in the low-temperature-resistant steel pipe is no less than 8 MPa, and opening the liquid nitrogen valve when the pressure of the liquid nitrogen in the low-temperature-resistant steel pipe is no more than 2 MPa, to continuously fill the liquid nitrogen.

3. The method according to claim 1, characterized in that:

the number of branch boreholes with the same angle and with the length of 30 m to 50 m uniformly distributed and directionally constructed along the horizontal direction of the coal bed is between 4 to 8.

* * * * *